US006435429B1

(12) United States Patent
Eichendorf et al.

(10) Patent No.: US 6,435,429 B1
(45) Date of Patent: Aug. 20, 2002

(54) FUEL INJECTION VALVE

(75) Inventors: Andreas Eichendorf, Schorndorf; Thomas Sebastian, Stuttgart, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/600,503

(22) PCT Filed: Jul. 29, 1999

(86) PCT No.: PCT/DE99/02332

§ 371 (c)(1),
(2), (4) Date: Aug. 31, 2000

(87) PCT Pub. No.: WO00/29739

PCT Pub. Date: May 25, 2000

(30) Foreign Application Priority Data

Nov. 18, 1998 (DE) ..... 198 53 091

(51) Int. Cl.[7] ..... B05B 1/30
(52) U.S. Cl. ..... 239/585.1; 239/585.5
(58) Field of Search ..... 239/585.1–585.5, 239/583, 584, 596, 533.1, 533.2, 533.12, 533.15; 251/129.15, 129.19, 129.21

(56) References Cited

U.S. PATENT DOCUMENTS 5,685,493 A * 11/1997 Grytz et al. ..... 239/585.1
5,915,626 A * 6/1999 Awarzamani et al. .... 239/585.1

FOREIGN PATENT DOCUMENTS

| | | |
|---|---|---|
| DE | 41 15 457 | 11/1991 |
| DE | 40 23 828 | 1/1992 |
| DE | 196 26 576 | 1/1998 |
| DE | 197 12 589 | 6/1998 |
| GB | 2 165 308 | 4/1986 |

* cited by examiner

*Primary Examiner*—Lisa A. Douglas
(74) *Attorney, Agent, or Firm*—Kenyon & Kenyon

(57) ABSTRACT

A fuel injector, in particular an injector for high-pressure fuel injection systems in internal combustion engines, has a valve closing body which works together with a valve seat face provided on a valve seat carrier to form a seal seat. Furthermore, a housing body which is part of a valve housing is also provided. A stroke adjusting disk determines the distance between the housing body and the valve seat carrier. According to the present invention, the stroke adjusting disk is arranged so that it surrounds a spray end of the housing body on the outside peripherally.

10 Claims, 2 Drawing Sheets

FUEL INJECTION VALVE

BACKGROUND INFORMATION

The present invention relates to a fuel injector.

A previously proposed fuel injector is described in German Published Patent Application No. 196 265 76. This fuel injector has a valve closing body that works together with a valve seat face designed on a valve seat carrier to form a seal seat. The valve closing body can be operated electromagnetically by a solenoid with a valve needle extending in the interior of the valve seat carrier and an armature connected to the valve needle on the end opposite the valve closing body. The valve seat carrier is inserted into a housing body and can be prestressed by a threaded ring which is screwed into the housing body against a stroke adjusting disk inserted between the housing body and the valve seat carrier. The stroke adjusting disk is thus located inside the housing body. The function of the stroke adjusting disk is to adjust the stroke of the valve closing body in electromagnetic operation of the fuel injector. A variation in thickness of the stroke adjusting disk thus leads to a variation in axial position of the valve seat face. The valve stroke is thus set for a certain length of the valve needle and a certain position of a stop face for the armature.

Before assembly of the fuel injector, various dimensions of the individual parts of the fuel injector that have an influence on the valve stroke are measured, and a suitable stroke adjusting disk is paired with it in such a way as to yield valve strokes in a very narrow tolerance range regardless of the manufacturing tolerance.

A disadvantage of the fuel injector described above is that the stroke adjusting disk has a relatively small diameter, and therefore there is not sufficient protection against tilting of the valve seat carrier in all applications. It is a particular disadvantage that the stroke adjusting disk is not located inside the housing body, and therefore, joining the housing body, the valve seat carrier and the stroke adjusting disk requires the stroke adjusting disk to be inserted into the interior of the housing body, which is complicated in terms of the manufacturing technology. Furthermore, there is the risk of soiling of the thread needed for the threaded ring.

A known fuel injector having a similar design is illustrated in FIG. 1 and is described in greater detail below. This design corresponds to that in Germans Published Patent Application No. 196 26 576 with regard to the arrangement of the stroke adjusting disk, except that the valve seat carrier is connected to the valve housing by a flange connection rather than by a threaded ring. This fuel injector also has the disadvantages described above.

SUMMARY OF THE INVENTION

The fuel injector according to the present invention however, has the advantage that the stroke adjusting disk can be installed easily and inexpensively because it is arranged on the exterior periphery with respect to the housing body. At the same time, this yields the advantage that the valve seat carrier is secured better against tilting with respect to the housing body by the stroke adjusting disk because of the relatively large diameter of the stroke adjusting disk.

Furthermore, it is advantageous that assembly of the stroke adjusting disk is not susceptible to soiling, and the number of individual parts is reduced due to the elimination of the threaded ring which is provided in the related art.

The stroke adjusting disk can preferably be inserted into a peripheral groove of the housing body and is in contact with the housing body on an inlet-side end face and with a peripheral projection of the valve seat body on a spray-side end face. The connection between the housing body and the stroke adjusting disk on the one hand and between the stroke adjusting disk and the valve seat carrier on the other hand can be accomplished by a weld. The stroke adjusting disk not only has the function of defining the axial position of the valve seat carrier with respect to the housing body and thus defining the valve stroke, but also at the same time has the function of a connecting element between the housing body and the valve seat carrier. The welds preferably cause a weld contraction strain which prestresses the housing body, the stroke adjusting disk and the valve closing body relative to one another. This yields an especially great strength.

Preferably an inlet end of valve seat body can be inserted into a spray end of the housing body, and these parts can be sealed with respect to one another by a seal. This has the advantage that the pressure of the fuel in the fuel injector does not advance as far as the stroke adjusting disk and the welds and thus there is no load on the welds due to the fuel pressure. The connection between the housing and the valve seat carrier as well as the stroke setting are therefore largely independent of the fuel pressure.

It is advantageous that the welds can be produced easily by welding tools applied externally and radially.

DETAILED DESCRIPTION

Figure 1:
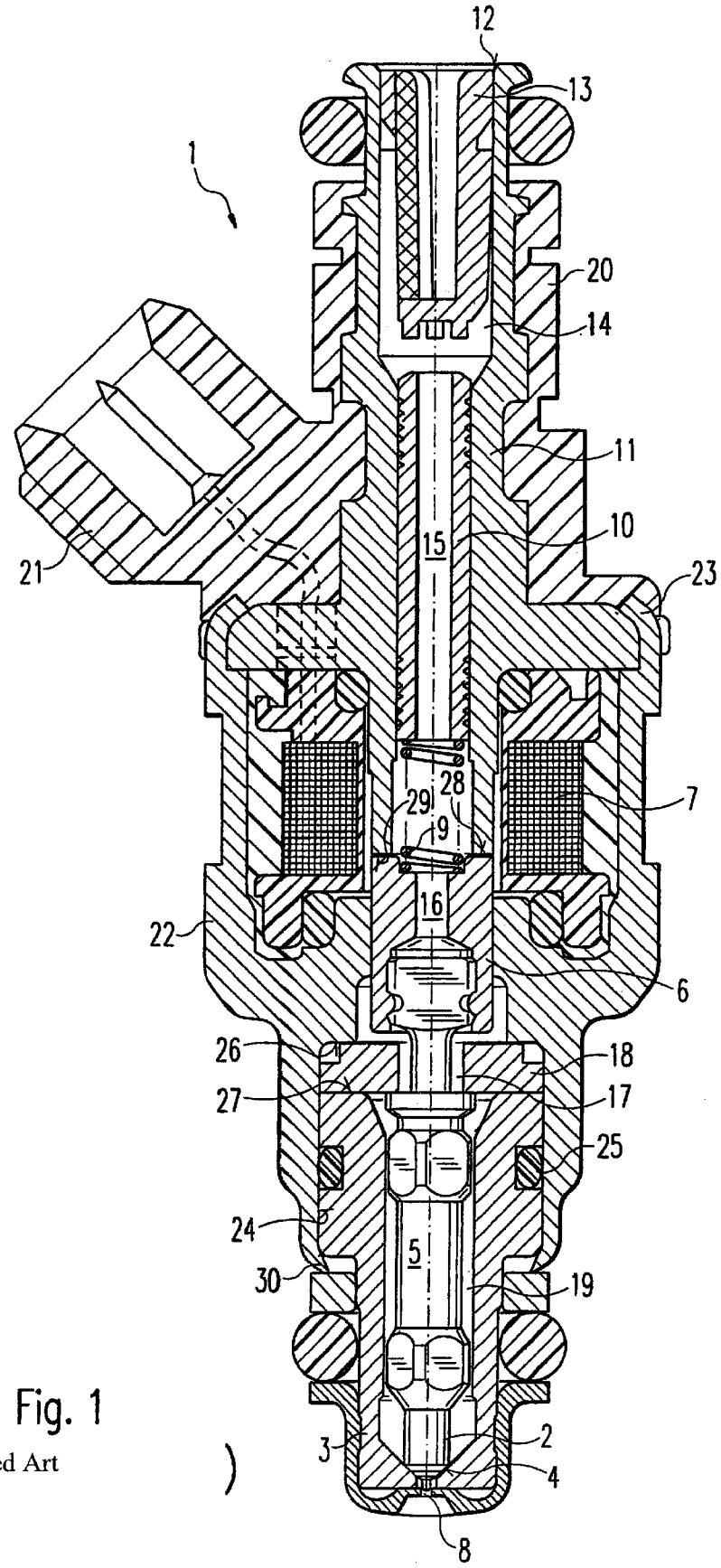
Fig. 1 ( Related Art )
FIG. 1 shows an axial section through a fuel injector according to the related art.

To facilitate understanding of the present invention, FIG. 1 shows a fuel injector according to the related art, so that the subsequent description of the embodiment according to the present invention can be limited to the particular details according to the present invention. The fuel injector illustrated in FIG. 1 is for injecting fuel, in particular in an internal combustion engine with externally applied ignition and compression of the mixture.

The fuel injector labeled with reference number 1 in general has a valve closing body 2 which works together with a valve seat face 4 designed on a valve seat body 3 to form a seal seat. Valve closing body 2 is connected by a valve needle 5 to an armature 6. An axial force component can act on armature 6 by way of a solenoid 7 so that valve closing body 2 is lifted up from valve seat face 4, releasing a spray opening 8. After the electric field current energizing solenoid 7 has been turned off, valve closing body 2 is returned to its closed position by a restoring spring 9 acting on armature 6. The initial stress of restoring spring 9 can be adjusted by an adjusting sleeve 10 connected by a thread to a first housing body 11. Fuel flows through a fuel inlet opening 12 and a fuel filter 13 into an axial longitudinal bore 14 in first housing body 11 and also into a longitudinal bore 19 of valve seat carrier 3 through an axial longitudinal bore 15 of adjusting sleeve 10 as well as a longitudinal bore 16 of armature 6 and a longitudinal bore 17 of a stroke adjusting disk 18 to be described in greater detail below, so the fuel reaches the seal seat formed by valve closing body 2 with valve seat face 4.

First housing body 11 is surrounded by a plastic injection-molded body 20 which also has an integrally molded plug connector 21 for electrically connecting a connecting cable to solenoid 7.

Furthermore, a second housing body 22 is connected to first housing body 11 by a first flange connection 23. Second housing body 22 has a longitudinal bore 24 into which valve seat carrier is inserted axially and sealed by a seal 25 with respect to second housing body 22. Valve seat carrier 3 and second housing body 22 are joined by a second flange connection 30.

Stroke adjusting disk 18 described above is provided between a downstream end face 26 of second housing body 22 and an upstream end face 27 of valve seat carrier 3.

Stroke adjusting disk 18 determines the valve stroke, i.e., the travel of valve closing body 2 from valve closing face 4 when fuel injector 1 is operated. The valve stroke is determined by a slight gap (not apparent in FIG. 1) between an upstream end face 28 of armature 6 and a downstream end face 29 of first housing body 11. This gap is in turn determined by the length of valve needle 5 and armature 6, measured from upstream end face 28 of armature 6 to the stop face of valve closing body 2 on valve closing face 4 of valve seat carrier 3, and by the axial position of valve seat body 3. Valve stroke therefore depends on the manufacturing tolerances of numerous components, in particular the manufacturing tolerance of valve closing body 2, valve needle 5, armature 6, valve seat carrier 3 and both housing bodies 11 and 22. Since the sum of these manufacturing tolerances is much greater than the tolerance to be demanded of the valve stroke, the dimensions of the above-mentioned components which determine the valve stroke are measured in a conventional method and a suitable stroke adjusting disk is paired with them. The thickness of the stroke adjusting disk 18 is selected or manufactured so that on the whole, the required valve stroke is achieved in a narrow tolerance window.

The present invention relates to an improvement in the arrangement and design of stroke adjusting disk 18.

Figure 2:
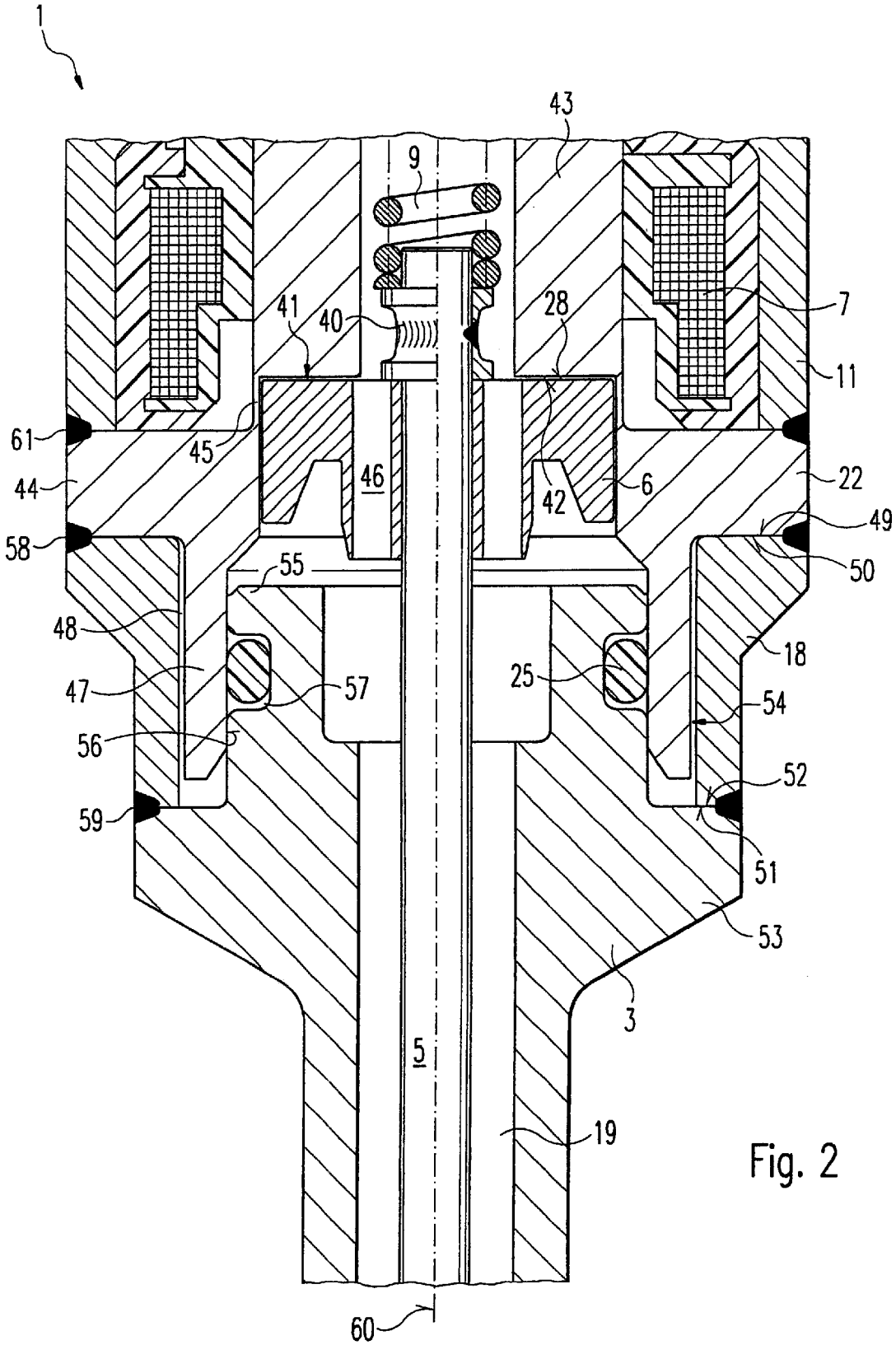
FIG. 2 shows a detail of an axial section through a fuel injector according to the present invention in the area of the stroke adjusting disk.

FIG. 2 illustrates an embodiment of a fuel injector 1 according to the present invention in a detail of a sectional diagram. Only those elements relating to the present invention are shown here. To facilitate understanding, elements described above on the basis of FIG. 1 are labeled with the same reference numbers.

FIG. 2 shows first housing body 11, second housing body 22, valve seat carrier 3, valve needle 5 running in an axial longitudinal bore 19 of valve seat carrier 3, armature 6 connected to valve needle 5, restoring spring 9 which acts on valve needle 5 and solenoid 7 via a flange 40. The valve stroke is determined by a gap 41 between inlet-side end face 28 of armature 6 and a spray-side end face 42 of a tubular section 43 of second housing body 22. Tubular section 43 is connected by a thin connecting web 45 to an area 44 of second housing body 22 which projects radially outward. Connecting web 45 is extremely thin so that most of the magnetic flux passes through armature 6 and a magnetic short circuit on connecting web 45 is prevented. Armature 6 has bores 46 to allow fuel to pass through.

According to the present invention, stroke adjusting disk 18 surrounds a spray end 47 of second housing body 22 on the outside peripherally. Stroke adjusting disk 18 is preferably designed in a ring shape. Stroke adjusting disk 18 is part of the valve housing and it can be inserted into a peripheral groove 48 on second housing body 22. At one inlet-side end face 49, stroke adjusting disk 18 is in flush contact with an opposing respective end face 50 of second housing body 22 when installed. A spray-side end face 51 of stroke adjusting disk 18 is in flush contact with an opposite, associated end face 52 of valve seat body 3. End face 52 which is opposite spray-side end face 51 of stroke adjusting disk 18 is designed on a peripheral projection 53 of valve seat body 3 in the embodiment illustrated in FIG. 2. Preferably a radial tolerance gap 54 is provided between stroke adjusting disk 18 and spray end 47 of second housing body 22.

An inlet end 55 of valve seat body 3 can be inserted into a mounting bore 56 of spray end 47 of second housing body 22, so that spray end 47 of second housing body 22, which is surrounded by stroke adjusting disk 18, in turn surrounds inlet end 55 of valve seat carrier 3. Inlet end 55 of valve seat carrier 3 is sealed at spray end 47 of second housing body 22 by peripheral seal 25. Seal 25 is preferably designed as an 0 ring and can be inserted in a radial groove 57 on inlet end 55 of valve seat carrier 3.

Stroke adjusting disk 18 is welded by a first peripheral weld 58 to second housing body 22 at its inlet-side end face 49 and by a second peripheral weld 59 to valve seat carrier 3 on its spray-side end face 51. From the standpoint of manufacturing technology, welds 58 and 59 can be produced easily with a welding tool working from the outside radially. Welds 58 and 59 do not extend over entire end face 49 and 50, 51 and 52. Due to this restriction on the depth of the welds, a portion of flat end faces 49 and 50 on the one hand and 51 and 52 on the other hand is preserved, thus imparting an exact axial alignment of valve scat carrier 3 with respect to center axis 60 of fuel injector 1 through stroke adjusting disk 18. The present invention utilizes in particular the weld contraction strain produced by welds 58 and 59. The weld contraction strain causes a prestress on second housing body 22, stroke adjusting disk 18 and valve seat carrier 3 relative to one another, so that a gap-free weld and a high strength can be achieved.

An important advantage of stroke adjusting disk 18 arranged on the outer periphery according to the present invention in comparison with stroke adjusting disk 18 arranged on the inside in second housing body 22 in FIG. 1 is the increased diameter of stroke adjusting disk 18. thus yielding a greater accuracy of the alignment of valve seat carrier 3 with respect to center axis 60 of fuel injector 1 and therefore a lower tolerance range in possible tilting of valve seat carrier 3. Another advantage is that stroke adjusting disk 18 can easily be inserted into peripheral groove 48 of second housing body 22 when fuel injector 1 is assembled, thus yielding a design of fuel injector 1 that is extremely easy to assemble. With the related art illustrated in FIG. 1, however, stroke adjusting disk 18 must be inserted into axial bore 24 of second housing body 22, which is more difficult to handle, especially in automated manufacturing. The arrangement and assembly of stroke adjusting disk 18 according to the present invention is also insensitive to soiling.

Seal 25 ensures that fuel flowing to the seal seat inside fuel injector 1 does not reach welds 58 and 59. Therefore, welds 58 and 59 are not exposed to the fuel pressure. This is important, especially with high-pressure injectors, where a higher fuel pressure of up to 150 bar prevails and nevertheless narrow tolerances in the valve stroke of 0.2%, for example, is to achieved. Welds 58 and 59 need not guarantee a leakproof seal, but instead they need only withstand the axial forces between second housing body 22 and stroke adjusting disk 18 on the one hand and between stroke adjusting disk 18 and valve seat carrier 3 on the other hand. Therefore, prestress forces during welding can be minimized. The threaded ring provided in the related art according to German Published Patent Application No. 196 26 576 is eliminated by welding stroke adjusting disk 18 to second housing body 22 and valve seat carrier 3 as done according to the present invention. Eliminating this: part reduces manufacturing costs.

First housing body 11 and second housing body 22 can be connected by another weld 61 which can also be applied externally.

According to the present invention, three functions are combined in stroke adjusting disk 18. Stroke adjusting disk 18 determines the valve stroke, it forms an integral part of the valve housing and it mediates the connection between second housing body 22 and valve seat carrier 3.

The present invention is not limited to the embodiment illustrated here. In particular, the arrangement of stroke adjusting disk 18 according to the present invention can also be used equally with fuel injectors 1 that open on the outside.

What is claimed is:

1. A fuel injector, comprising:

a valve housing including at least one housing body;

a valve seat carrier arranged with respect to the valve housing;

a valve seat face provided on the valve seat carrier to form a seal seat;

a valve closing body working together with the valve seat face; and a stroke adjusting disk for determining a distance between the at least one housing body and the valve seat carrier and surrounding an end of the at least one housing body on an outside peripherally, the end of the at least one housing body facing a spray end of the valve seat carrier.

2. The fuel injector according to claim 1, wherein the fuel injector is for a high-pressure fuel injection system in an internal combustion engine.

3. The fuel injector according to claim 1, wherein:

the stroke adjusting disk is a part of the valve housing.

4. The fuel injector according to claim 1, wherein:

the at least one housing body includes a peripheral groove into which the stroke adjusting disk is capable of being inserted so that an inlet-side end face of the stroke adjusting disk is in contact with a respective end face of the at least one housing body, and a spray-side end face of the stroke adjusting disk is in contact with a respective end face of the valve seat carrier.

5. The fuel injector according to claim 4, wherein:

the respective end face of the valve seat carrier is formed on a peripheral projection of the valve seat carrier.

6. The fuel injector according to claim 4, wherein:

the stroke adjusting disk is welded to the at least one housing body by a first weld on the inlet-side end face of the stroke adjusting disk, and on the spray-side end face of the stroke adjusting disk, the stroke adjusting disk is welded to the valve seat carrier by a second weld.

7. The fuel injector according to claim 6, wherein:

the first weld and the second weld do not extend radially over an entire surface of the inlet-side end face of the stroke adjusting disk and the spray-side end face of the stroke adjusting disk, and the first weld and the second weld are formed without any gaps.

8. The fuel injector according to claim 6, wherein:

the at least one housing body, the stroke adjusting disk, and the valve seat carrier are prestressed with respect to one another by a weld contraction strain produced by the first weld and the second weld.

9. The fuel injector according to claim 1, wherein:

an inlet upstream end of the valve seat carrier is inserted into the end of the at least one housing body facing the spray end of the valve seat carrier so that the end of the at least one housing body facing the spray end of the valve seat carrier and surrounded by the stroke adjusting disk surrounds the inlet end of the valve seat carrier.

10. The fuel injector according to claim 19, further comprising:

a seal, wherein:

the inlet end of the valve seat carrier and the end of the at least one housing body facing the spray end of the valve seat carrier are sealed relative to one another by the seal.

* * * * *